United States Patent [19]

Malloy

[11] Patent Number: 4,609,124

[45] Date of Patent: Sep. 2, 1986

[54] UNIVERSAL GRAVITY ACTUATED CONTAINER-LID

[76] Inventor: Wilson J. Malloy, 1009 # 1 N. Second St., El Cajon, Calif. 92021

[21] Appl. No.: 718,742

[22] Filed: Apr. 1, 1985

[51] Int. Cl.[4] ..... B65D 17/50; B65D 41/02

[52] U.S. Cl. ..... 220/260; 220/263; 220/264; 220/331

[58] Field of Search ..... 220/260, 263, 264, 331, 220/332, 335, 345

[56] References Cited

U.S. PATENT DOCUMENTS 3,995,764 12/1976 Zagami ..... 220/263

*Primary Examiner*—George T. Hall

[57] ABSTRACT

A unique self-actuating apparatus, basically useful in a wide variety of different type containers; said apparatus serving to automatically bias a substantially flat lid or top cover member from a normally horizontal/closed modality, to an alternate vertical/open modality, via effect of gravity acting thereupon; by virtue of a weighted guide member hingedly affixed to the lid in a manner as to result in the desired function whenever the container is lifted from a rested position. Hence, when combined with a drinking-cup, the novel actuator serves to instantly open a lid by the mere raising of the vessel from the counter surface for a drink—and conversely, snaps the lid shut whenever the cup is returned to rest; thereby providing carefree sanitary and thermal sealing advantages. The system also includes a novel 'safety provision' for adaptation of the G-lid principle to a juvenile toy-chest, thereby effectively defeating chance of accidental, or even intentional, return of the lid to the closed position by an infant child, yet is easily reclosed by the parent.

10 Claims, 5 Drawing Figures

UNIVERSAL GRAVITY ACTUATED CONTAINER-LID

FIELD OF INVENTION

The present invention relates to lid closures, and related top closure actuating mechanism, system, or apparatus, which are devised to provide the user a combination of convenience and care-free-usage. Furthermore, the aspect of 'safety' is also identified with the provisions of this invention. Heretofore, for example, there has been a critical problem with the function of Lid-closures of Juvenile toy-chests, which can hingedly fall closed upon a small helpless child, and either trap them inside—or, catch them by the neck. Either event resulting in a potential tragedy, which this invention overcomes by virtue of its novel gravity-actuated biasing action. Accordingly, some modern computer-cabinets by way of further example, have a dust-cover panel, which is desirably deployed away and essentially out of sight of the working-area; and the novel G(gravity)-lid system set forth herein shall serve to obviate any complex linkages, springs, magnets, guide-gears, etc. traditionally associated with these sort of products. Such reduction of component members is the basis of good functional engineering, the provisions of this ultimately simple G-lid device is considered important to general product improvement, and cost reduction.

Moreover, the basic operating principle of this invention, enables it to serve in a wide array of usages, not the least significant of which is its embodiment into virtural automatic action for drinking-vessels having the desirable advantage of a protective-lid, which heretofore has always been an inconvenience, essentially requiring a certain degree of manual dexterity by the user. The G-lid requires none, nor any initial user instruction. There is nothing about the G-lid in its preferred embodiment, which requires the user to press, push, pull, or hold; and the G-lid operates as fast, or slowly, as the user initiates action!

Furthermore, it has been the observation, that prior efforts by others to create a novel acting closure device, resulted in some difficulty with cleaning, or in added complexity; while this invention exhibits no such disadvantages. In fact, this novel G-lid system offers real sanitation advantages, considering that it prevents airborne contaminants such as dust & insects from settling upon the rim, or within the container cavity thereto; while in the case of a drinking-cup, will, in the next instant virtually disappear—thereby enabling the user to truly 'savor' the full aroma, and to enjoy a full visual 'sight' of the contents. Ordinary conventional 'mobile-cup' configurations, designed to be used by task-occupied persons such as Truckers, have traditionally resorted to either some form of tricky thumb-actuated hinged-lid, or, a fixed-lid having a tiny 'sip-aperature' through which a beverage may be attained, while with some difficulty. Additionally, the novel G-lid is able to effectively keep hot-drinks 'hot', and cold-drinks 'cold' by virtue of its automatic-closure operation, which also serves to substantially obviate occurence of slosh-over spillage.

Thus, while is is believed that the greatest profit potential for Mfg. & Mkt. of this invention lays in its convenience as an improvement to drinking-cups that everyone has a need for, it remains that allied usages, such as a simple, inexpensive Convertible-top for a specially constructed Sports-car, will be appreciated.

SUMMARY OF INVENTION

It is therefore, the object of this invention, to provide a basic closure-lid or top device, suitable for a wide diversity of product applications; such as for Sanitary-waste containers, Cigarette-humidors, Jewelry-boxes, or a modern 'drop-top' Desk; within all of which it is desirable to provide a 'stow modality' during use.

It is accordingly, the further object of this invention, to provide a Drinking-cup with a novel, inexpensive, unobtrusive, normally-closed lid-member; which is activated merely upon initial lifting of the cup by the user—and conversely, deactivated by subsequent replacement ro rest.

It is another object of this invention, to provide a 'safety' type of G-lid system, which is activated merely by initial tiping-action applied to the leading-edge of the G-lid member—whereupon the force of gravity will serve to continue the opening sequence, as the G-lids' center-of-balance passes a given aftward fulcrum-point; said point being preferably a beveled-edge over which the G-lid member is biased in combination with a hingedly-acting weighted portion which is always deployed vertically within an aft-guide means.

It is another object of this invention, to provide an aft-guide means, in the form of an externally-acting rail or channel like method, disposed in a substantially vertical manner relative to the primary container per'se.

It is another object of this invention, to provide an aft-guide means, in the form of an internally-acting rail or channel like method, disposed in a substantially vertical manner relative to the primary container per'se.

It is another object of this invention, to provide a self-actuating G-lid member, which may be easily extracted from the container guide-system, for occassional cleansing, or, for optional placement into a convenient 'stow'-mode of usage.

It is another object of this invention, to provide a combination lid & weighted actuator aggregate, whereby the said lid is normally disposed in a substantially horizontal attitude during the 'closed'-modality, while the said weighted portion is always disposed in a substantially vertical attitude; whereas, when the lid section is drawn to the alternate 'open'-modality, it is disposed in a substantially vertical attitude, perferably within a common guidance system.

It is another object of this invention, to provide a lid & weighted-actuator aggregate, which are made hingedly together, so that the former said may be drawn substantially by the force of gravity by the latter said, into an open vertical attitude; said lid & weighted-actuator portions thereby utilizing a common guide-channel, and thereby disposed to a substantially vertical attitude therein when so actuated.

It is another object of this invention, to provide a special 'travel-stop' entity, which serves to prevent the G-lid(lid & weighted-actuator aggregate) from droping away through an opened-ended vertical guide-channel. It is another object of this invention, to provide a special 'limiter-tab' which would serve to prevent the G-lid from opening to a fully vertical attitude, thereby always ready fall from a slightly canted pitch in the fully-opened position, to a fully closed modality; said limiter-tab to essentially be a mere vertical extension of the weighted-actuator slide portion of the G-lid aggregate, said limiter-tab acting to block hinging of the lid portion to a less than vertical attitude.

It is another object of this invention, to provide a drinking-vessel which may be predominantely made of inexpensive extruded production methodology; requiring only the insertion of a seperately made bottom portion, and the G-lid member, into an integrally extruded guide-channel thereto, in order to achieve an automatic self-acting action, in accordance with the parameters of this invention.

It is another object of this invention, to provide an automatic self-actuating G-lid container, having an adjoining guide-rail arrangement, and the said G-lid includes a coacting weighted-actuator portion which is made to pass substantially below the bottom of the container, so that upon replacement of the container to the rested position, the said W-actuator is forced upwards, until resting flush with the bottom of the container; whereby the G-lid is caused to become reclosed.

It is another object of this invention, to provide a G-lid member in a special configuration which includes an 'anti-spill' feature, in the form of an annular rim like boss portion, which is located on the lid-underside so as to fall within the annular-lip of the drinking-cup; thereby effectively negating accidental sloshing-over said rim lip, of any beverage content therein.

While this invention will be described in conjunction with certain preferred embodiments, it is intended that this not limit the invention to such features; as on the contrary, it is intended to cover all alternatives, modifications, and such equivalents which may be included within the spirit & scope of the invention, as is defined in the following Specifications. This invention was first revealed in my Pat. Office 'Document of Disclosure'/#118772 (July 15, 1983), and is even further predated by my earlier private records.

BRIEF DESCRIPTION OF THE DRAWINGS

The preceeding summary, as well as further objects, features, and advantages of the present invention, will be more fully appreciated by reference to the following detailed descriptions of the present illustrative embodiments, which are in accordance with the present invention; wherein.

DETAILED DESCRIPTION OF THE INVENTION

Figures 1, 2, 3, 4, 5:
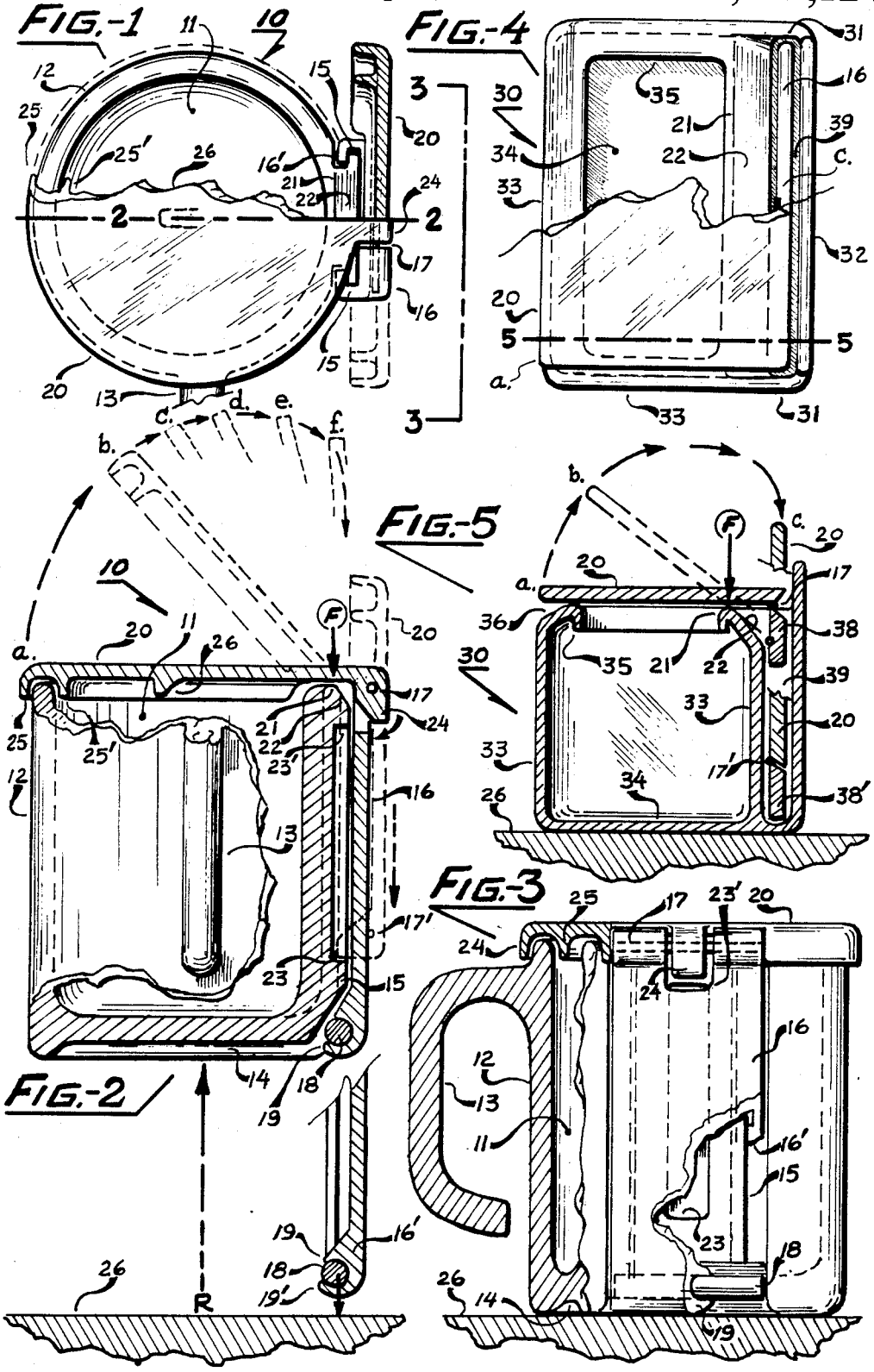
FIG. 1, is an upper/plan-view of the invention as an exemplary drinking-vessel, showing preferred relationships of the conventional portions, in conjunction with the selected parts of novelty; including a combination of cut-away & phantom indications of the lid member thereto.
FIG. 2, is a side-elevation view of the proceeding FIG. 1, wherein portions are also revealed in cut-away & cross-sectional fashion, including a dotted-line phantom indication of the open-modality, shown in sequential events of 'a,b,c,d,e,f' for sake of clarity.
FIG. 3, is an alternate side-elevation view of the preceeding embodiments, however rotated 90-degrees, and includes a partial cut-away of the cup-wall and of the W-slider for sake of clarity.
FIG. 4, is a modified version of the invention, shown in plan-view, and in partial cut-away of the Top-panel part only.
FIG. 5, is a cross-sectional/side-elevation view of the preceeding embodiment; wherein the Top part is indicated in a 3-sequence repersentation, and the lower portion is entirely revealed in cross-section for clarity.

The invention shall now be specified in reasonable detail, according to the preferred claims, and with direct reference to the exemplary illustrated embodiments, reference numbering is for convenient identification purposes only.

The representational views of FIGS. 1, 2, 3, reveal an easily injection-molded plastic drinking-vessel as a common embodiment, wherein 10 is an essentially conventionally configured Cup portion, having cavity 11 formed by wall 12 to which is affixed a lifting-handle 13, and includes a slightly recessed bottom portion 14. While it is indeed possible to make the following attendant parts of extruded-plastic or sheet-metal stampings so that they simply snap-on to such a conventional Cup, the version addressed here shall reveal the novel elements as an integrally made embodiment of a special Cup. Thus, it is seen clearly in FIG. 1 that the outwardly opposed 'internal-flange' guide-system channel 15 is formed out of the cup wall 12, and extend substantially the height of the cup as indicated in FIG. 2 so as to provide positive guidance for the cooperating 'external-slider' or W(weighted)-slider 16 having inwardly opposed flange entities 16'.

Action is caused by the user manually raising (see R, FIG. 2) the Cup 10 from any countertop 26, which enables the said W-slider 16 to freely fall below the bottom of the Cup, and is assisted by a cylinderical lead-weight 18 permanently inserted into the biforcated fingers 19 & 19' formed integrally with the said W-slider 16. Thus, what is effected here, is virtually a semi-automatic actuation of the G(gravity)-lid aggregate including primarily the Top 20, which in FIG. 1 is indicated in its normally-closed modality (Ref: lower half), but for sake of clarity in function, is also indicated in its fully opened-modality (Ref: upper half), by use of cut-away & phantom-view.

Accordingly, FIG. 2 reveals the novel loci-of-instant-sequential-motion, or locus of transition-points, whereby it may be observed that owing to the novel vertically-traversing-hinge action, an unusual geometry is described, which is brought about in combination with the F(fulcrum)-point 21 arranged as a portion of the cups' upper central rim region for lowest imposed drag-friction, and also includes a desired chamfered portion 22 thereto, which serves to enhance the resulting leverage-effect imposed upon said Top 20 by the pull of gravity upon said countered-weighted W-slider 16. Therefore, as the W-slider 16 is freed to drop or fall away, the integral tang or T(tang)-stop 24 commences to pivot about the transitional hinge-point 17, so that at about the 50-degree attitude of the opening Top 20 (Ref: FIG. 2), the said T-stop 24 enters a free-travel portion of the L(limiter)-stop 23, wherein engagement of said T-stop & L-stop members prevent the W-slider 16 from falling entirely through said Guide channel 15 in an undesired manner.

Hence, it is to be understood that the invention example suggested here, is shown in the inventors preferred clean-lined embodiment, and that as such, any locative variation of the said T-stop 24, such as arranging it as a tab extending outward from the underside of the Top 20, so as to engage a fixed upper portion of the said guide channel 15, is obviously tantamount to the invention embodiment being disclosed hereof. Likewise, with any locative variation of the L-stop 23, such as if arranged as an upwardly extending tab like portion of the W-slider 16 which would serve to block the Top 20 from a backward fall from the substantially vertical attitude. In fact, such an alternate embodiment (not shown for reason of illustration clarity) would preferably limit the Top 20 to an opened attitude of about 86-degrees from the horizontally closed modality—thereby imposing a slight tilt to the opened-top, for quicker-return action; although in the version shown here, return contact of the said T-stop 24 with the fixed upper portion of the L-stop recess 23', will provide similar but more positive cam-action toward the closed-modility. Also shown in FIG. 2 is a small tit-ramp entity 26 which merely serves to eliminate any excessive play of the Top 20 while in the open-modality. It should be noted here also, that if the subject drinking-vessel were to be designed as an inexpensive expendable item, then the latter said alternate embodiment would provide a convenient place to apply an advertising-logo, such as for a beverage company for example; while in the preferred embodiment as shown in the illustrations, such advertising or other decoration would necessarily have to be applied to the Top or Cup-wall portions if desired.

Note also, that regardless as to the aggregate variations, the Cup body 12 replete with said guide system 15, is desirably made detachable from the attendant G-lid members 16, 17, 20, etc., by simply lifting the latter said aggregate up and away from the remaining special cup-body 12; thereby making it easier to cleanse the aggregate members seperately. Additionally, in versions of the invention where the external/anti-slosh rim 25 and internal/anti-slosh rim 25' are omitted, and the alternate 'external-flange' guide-system of channeling is employed, the entire Top & W-slider aggregate may be simply extracted, folded flatly upon themselves, and subsequently inserted back down into the said externally enshrouding guide-channel—as an optional modality of usage.

Moreover, while the hinging arrangement shown here is a simple straight pin 17 passing through the two tab like extensions of the W-slider 16, and through the single tab like entity portion of the Top 20; it is granted that several variations may be employed, such as a hinge means made of flexible-tape—yet, remaining tantamount to the embodiment herein disclosed. Likewise, if a W-slider member were made entirely of a heavy-metal such as cast-zinc instead of the light-weight plastic design shown here, then it would be possible to eliminate the weight-insert 19—again, tantamount to a weighted-slider 20.

By way of demonstrating how the basic G-lid principle may be adapted to various other products as well, FIGS. 4 & 5 reveal a childs Toy-chest 30, which could even have been an example of employing the invention as a Convertible-top for a Sportscar. Here, we see the alternate external/guide-system, having a brief wall extension portion 31, and continuous therewith, an enclosed aft-wall portion 32; said aft-wall being optionally devised as a divided-flange arrangement, more like the cross-sectional configuration of the external/W-slider 16 of FIG.'s-1, 2, 3, for example. Included in this exemplary embodiment, is the main box like walls 33 and bottom 34 of the assembly, including a return-flange 35 which is merely formed as an integral portion, along with a convenient finger-access recess 36 enabling an Infant-child to easily tilt Top-panel 37 from point-'a' to about the 45-degree attitude suggested at point-'b', whereupon the novel self-biasing effect of the W-slider 38 will automatically continue the opening action until point-'c' is reached, and the W-slide 38 bottoms-out. Since the combined weight of the G-lid aggregate, replete with Top 20 and W-slide 38 are to much for any Infant-child to manipulate upward from the enshrouded Guide-channel confine 39, an important 'negator effect' is created as a safety provision of this invention. Thus, when it is desired to restore the G-lid aggregate to the closed-modality, only an older Child or Adult can accomplish the task; thereby making the Toy-chest 'safe' while in the use of an unsupervised Infant-child.

Lastly, it will be apparent to those skilled in the art treated herein, that still further changes, alterations, and modifications, may be resorted to according to the concept set-forth in the present embodiment, without departing from the intended spirit & scope of the invention which is further recited in the appended claims and their legal or technical equivalents.

What I claim of originality is:

1. A "Gravity-lid" or G-lid apparatus, the purpose of which is to provide the user with convenience of a semi-automatic opening function for a variety of containers (or housings) which would otherwise have an exposed open-cavity region (or top-area surface); said G-lid featuring a structurally simple aggregation of co-acting members comprising:

A Top member, formed as a substantially flat panel in side-elevation/cross-section, but which can have a rounded or squarish appearing projected major surface area, which is disposed in an approximately horizontal attitude in the closed condition of usage;

A Weighted-slider (or W-slider) component, which is part of the said Top member, but serving as a vertically-jointed/side-extension thereto, giving the essential weight-bias needed to draw the said Top over the transitional Fulcrum-point;

A Fulcrum member, arranged in a fixed manner to one side of the said cavity or surface region, which cam-like presence causes the over-riding Top member to follow a particularly rapid pivotal transition action described as a 'loci-of-points' between the extreme open & closed positions of said Top;

A Guide-rail (or G-rail) arrangement, set substantially vertical with the said container side, so as to provide a positive plane of slide-travel, which will ultimately locate the Top immediately beside the outer surface of said wall while in the open modality of use; hence, serving as a positive control means, suitably coupled between said Top and said wall by means of constant slip-fit engagement;

A Travel-negator (or T-negator) designed relative to co-acting movements of the Top and the container Wall, so as to positively limit the extent of Top transfer to a predetermined vertically opened position, yet allowing the Top & W-slider aggregate to be readily extracted if desired, as a seperable sub-assembly detached from the G-rail fixture.

2. In a G-lid apparatus according to claim 1, whereby said container device is preferably made in a hand-portable Drinking-cup or Serving-tray embodiment, preferably replete with customary handle thereto, whereby the user unwittingly initiates a unique siem-automatic opening action of the Top—simply by virtur of wilfully lifting the vessel from a natural resting position on its base—thereby enabling the 'force of gravity' to act by instantly lowering the said W-slider member downward while in vertical slip-fit retension with said G-rail provision, and thus by virtur of a weight-bias simultaneously drawing the jointably attached Top member over said F-point, and hence, following said attached portion downward until the Top is opened in a substantially vertical attitude, essentially retracted away from interference with drinking usage; whence upon completion, the user need merely restore the said container back to its natural resting position, causing the bottom extended portion of the W-slider to be sent sliding back upward until flush with the attendant container bottom surface, the effect of which has thus reversed the above said sequence of events, so as to cause the said Top to flip back to a closed position—without actual attention by the user.

3. In a G-lid apparatus according to claim 1, wherein is included an optional Limiter-tab provision in the form of an abbreviated upward extension of the W-slider component, above the Top while inthe closed position. Said L-tab protruding sufficiently above the said F-point in a 'slightly catntd' attitude, so as to thus exert a slight positive tiping force against the opened Top member once the bottom extended W-slider has again begun contact with a resting surface; and L-tab serving additionally as an ideal visual area for graphic-display of advertising or decorative effects, if so desired by either the maker or the user.

4. In a G-lid apparatus according to claim 1, wherein said T-negator is preferably configured in the form of an integral tab like entity, made so as to extend outward from the actual maximum-width to th said Top member, thus causing ultimate engagement of said T-negator upon the G-rail memeber; hence, serving to set a limit on the extent of travel of the Top, to a point only slightly above the C-section type of G-rail configuration, although the said W-slider member is protruding below the bottom of the container's under surface.

5. In a G-lid apparatus according to claim 1, wherein said T-negator is preferably configured in the form of an integral Limiter-stop formation, as an abutment situated near the lower aft region of the G-rail & container-wall, and acting in conjunction with a vertically aligned Tab provision formed into the underside of the Top at the region where jointed attachment is made to the W-slider; hence, enabling the said Top-tab and the said container-abutment surface to become resultantly engaged, so as to thereby stop further downward travel of the Top & W-slider aggregate, whereby the W-slider is extended well below the bottom surface of the container.

6. In a G-lid apparatus according to claim 1, wherein action is limited to semi-automatic operation inthe opening-mode of Top use, whereby an initial manual lift need be exerted only initially upon the frontal edge of the said Top member, whereupon an abbreviated vertical W-slider member is able to assume sufficient mass-bias as to then automatically continue the opening sequence of said Top to the full aft vertical stow position, although in this embodiment the said W-slider shall preferably not protrude below the bottom surface of the container; hence, an ideal 'negator effect' is attained, which may be particularly useful as a safety-device—as for example in preventing instances of Infant-mortality Syndrome when caused by an item such as a Toy-chest which Top-lid accidently falls, catching the Infant at the neck.

7. In a G-lid apparatus according to claim 1, wherein said W-slider is preferably made in a substantially flat-configuration, or, substantially arched-configuration, as may be dictated by the attendant vertical-wall conformation of the container thereto; said W-slider being coupled to the Top member via any suitable manner of jointing—such as an ordinary hinge-pin & linkage method, or by flexible-plastic or adhesive-tape for example, so as to obtain a reliable flex-joint provision between said members.

8. In a G-lid apparatus according to claim 2, wherein said Top member is preferably formed to a substantially flat shaped panel from which is extended downward a perimeter debossment-flange, the provision of which serves as an integral anti-slosh rim, thereby giving better sealing effect against the loss of internal liquids; said feature being particularly helpful during the more dynamic conditions of usage, such as while driving or walking.

9. In a G-lid apparatus according to claim 1, wherein said G-railing system is tantamount to a mono-rail like arrangement, set vertically with the container side-wall; whereby the special W-slider member is preferably made with a C-section slipper formation, so as to retainable grasp the attendant G-rail in a slip-fit manner—thereby positively controling the guide-path of the Top and W-slider aggregation.

10. In a G-lid apparatus according to claim 1, wherein said G-railing system is tantamount to a tongue & groove like arrangement, set vertically with the container side-wall; whereby the special W-slider is preferably made as the slip-fitting tongue portion, while the fixed-groove portion is formed outwardly thereto as an extension of the container side-wall—thereby positively controling the guide-path of the Top & W-slider aggregation.

* * * * *